United States Patent [19]

Guéret

[11] Patent Number: 4,503,872

[45] Date of Patent: Mar. 12, 1985

[54] MAKE-UP UNIT WITH A SAFETY FASTENER

[75] Inventor: Jean-Louis M. Guéret, Paris, France

[73] Assignee: L'Oreal, Paris, France

[21] Appl. No.: 460,855

[22] Filed: Jan. 25, 1983

[30] Foreign Application Priority Data

Feb. 19, 1982 [FR] France ..... 82 02808

[51] Int. Cl.[3] ..... A45D 40/30

[52] U.S. Cl. ..... 132/88.5

[58] Field of Search ..... 132/88.5, 88.7, 73; 401/122, 126, 128

[56] References Cited

U.S. PATENT DOCUMENTS

| | | | |
|---|---|---|---|
| 4,407,311 | 10/1983 | Gueret | 132/88.5 |
| 4,437,477 | 3/1984 | Gueret | 132/88.5 |
| 4,446,880 | 5/1984 | Gueret | 132/88.5 |

*Primary Examiner*—Gregory E. McNeill

*Attorney, Agent, or Firm*—Cushman, Darby & Cushman

[57] ABSTRACT

A make-up unit comprises a container and an applicator provided with a spatula to carry and to apply the make-up composition. The applicator has an inner stem carrying the spatula and surrounded by a handle-defining sleeve, which, in the closed position of the applicator on the container surrounds the neck of the container. Tabs can be depressed to release catches which hold the applicator in place.

14 Claims, 5 Drawing Figures

MAKE-UP UNIT WITH A SAFETY FASTENER

DESCRIPTION

The present invention concerns a make-up unit comprising firstly a container for a make-up composition, in particular, eye shadow, cheek blusher or a eye ring camouflager and secondly a detachable applicator closing the make-up unit and effective for carrying a make-up device allowing the make-up composition contained in the container to be taken up, carried to, and spread on the skin.

In U.S. patent application Ser. No. 377,172 filed May 11, 1982, there has already been described a make-up unit wherein the detachable make-up applicator is formed by two elements fitted one within the other and interconnected to enable relative movement of one relative to the other, that one of these two elements which does not carry the make-up member being provided with means for detachably fixing it on the wall of the container neck. One of the drawbacks of make-up units of this type lies in the fact that the stem of the applicator comes into contact with the container neck and since, in use, the make-up device is liable to come into contact with the inner wall of the container neck and to soil it, resulting in a deposit of make-up composition on the applicator stem, the applicator may be held only by its cap otherwise the operator's fingers may become soiled by make-up composition.

The present invention aims to eliminate this drawback thanks to a new arrangement wherein the applicator stem is fixed to the cap surmounting the make-up unit whilst being kept central within this cap by means of incorporated means of guidance. This arrangement limits the bolts on the container neck and hence reduces the extent of this type of product loss whilst allowing the user to grip the applicator by its cap without her fingers coming into contact with the stem.

The present invention therefore provides a make-up unit comprising a container for liquid make-up composition provided with a neck and a resilient sleeve; and a detachable applicator constituted by (a) an applicator stem whose lower end carries a make-up member and bears in a leak-proof manner on the bottom of the resilient sleeve, the make-up member passing through an opening of the said bottom to penetrate into the container and (b) a cap surmounting the unit and integral with the applicator stem, wherein the central stem is connected to the cap by an elastic connection so as to obtain a relative translational axial movement between the cap and the central stem; and wherein the cap of the applicator has at least one cut-out defining a tongue whose lower edge is on completion of the assembly of the unit positioned at the level of at least one relief formation provided on at least one longitudinal flexible tab carried by the neck of the container, the or each said relief formation being intended to be engaged in a slot defined by the lower part of the respective cut-out to lock the make-up unit, this tongue allowing the relief formation to be retracted by pressing on said at least one flexible tab and allowing the separation of applicator from the container by translational movement.

In a preferred embodiment, the elastic connection is formed by a plurality of upwardly bent cross pieces fixed on the one hand to the side wall of the cap, and on the other hand to a flange which is force-fitted in a peripheral groove arranged on the central applicator stem; the elastic connection is advantageously moulded integrally with the cap; the or each relief formation is a catch having a shoulder opposite the lower lip of the slot and a bevelled zone sloping towards the free edge of the tongue; the cap is formed on the one hand by a cylindrical element forming its outer wall and on the other hand by a cover closing the said cylindrical element at its top part; the cover of the cap is provided with a socket for the upper end of the central applicator stem; the make-up member is formed by an oblong spatula comprising at least one through hole constituting a reservoir wherein the liquid make-up composition is held by capillarity; the resilient sleeve has its bottom pierced by the opening, and this constitutes the wiper lip for the spatula of the make-up member; two diametrically opposite tongues, each having a bulge on its outer side, are arranged on the side wall of the cap of the unit and cooperate respectively with two catches carried by two flexible diametrically opposite tabs on the container neck so as to lock the applicator releasably on the container.

In order that the present invention may more readily be understood the following description is given, merely by way of example, of an embodiment represented in the accompanying drawings in which.

Figure 1:
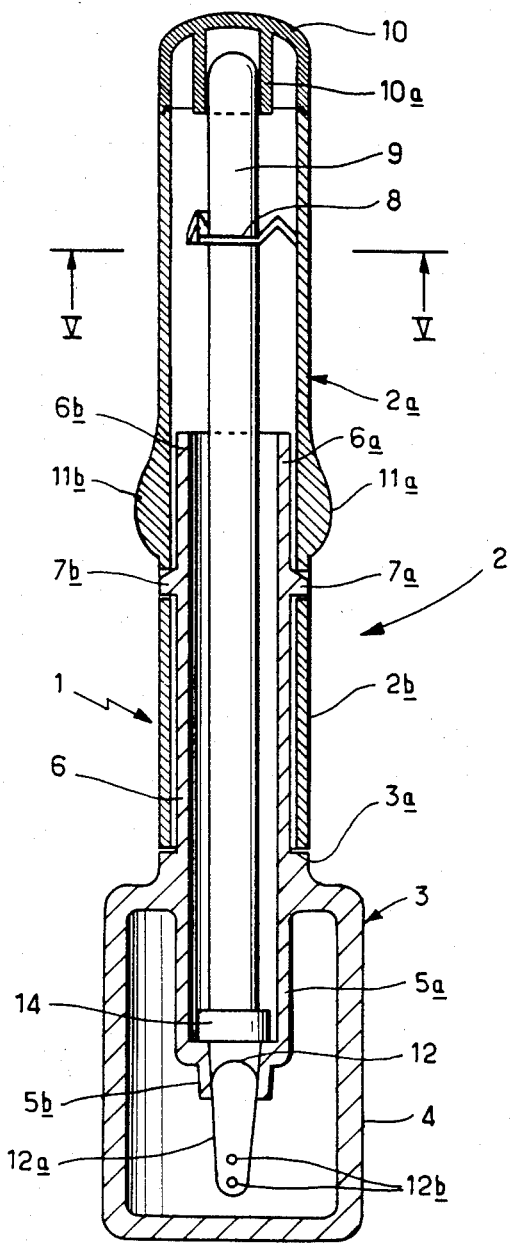
FIG. 1 is an axial cross-section of a make-up unit according to the present invention.
Figure 2:
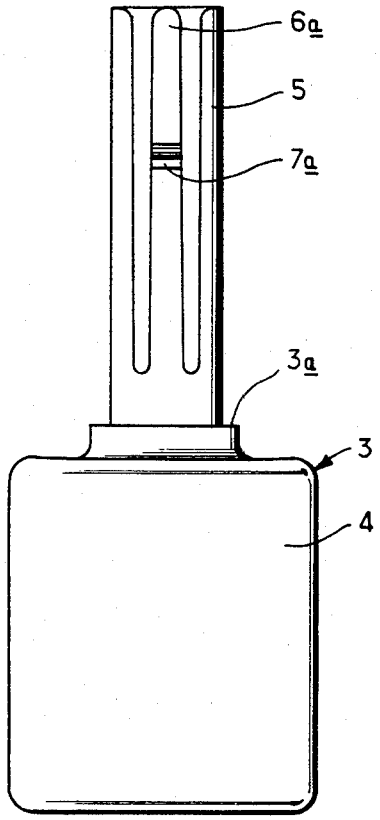
FIG. 2 is an elevational view of the container of the make-up unit of FIG. 1.
Figure 3:
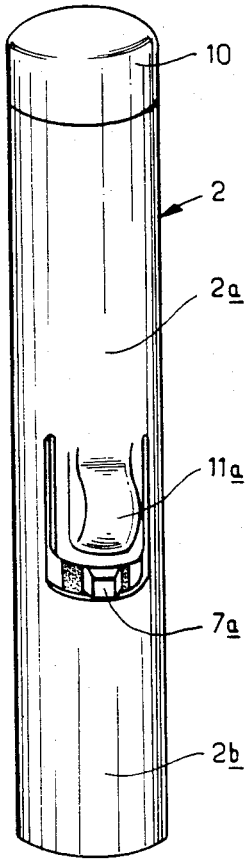
FIG. 3 is a view in perspective of the cap of the make-up unit of FIG. 1.
Figure 5:
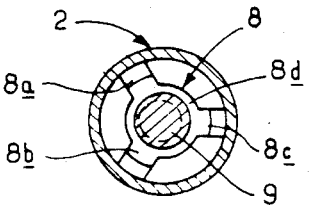
FIG. 5 is a transverse cross-section along the line V—V of FIG. 1.
Figure 4:
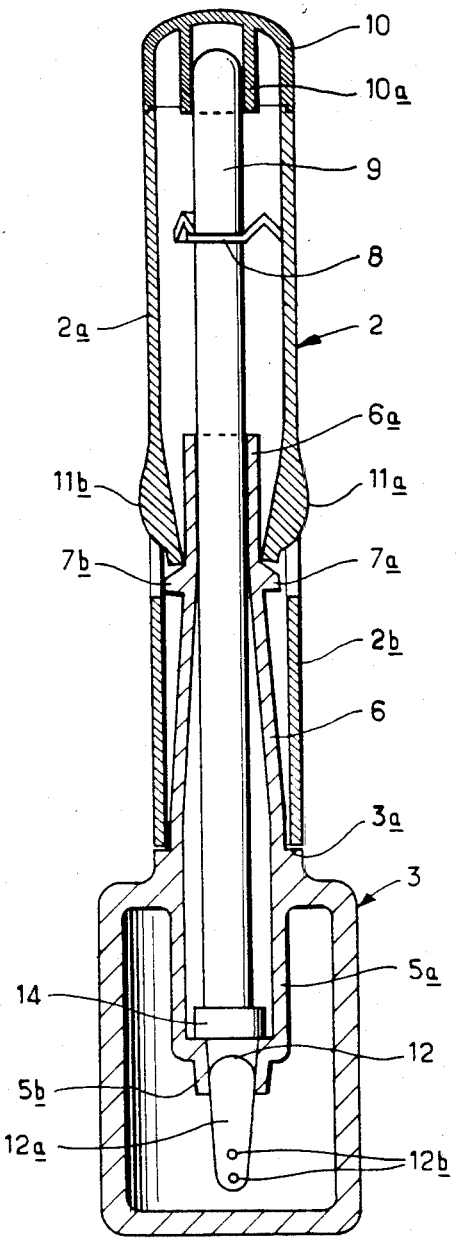
FIG. 4 is an axial cross-section of the make-up unit of FIG. 1 during the process of unfastening prior to the use of the applicator.

The make-up unit designated as 1 on the drawing comprises an applicator 2 associated with a container 3 containing liquid eye shadow. The container 3 comprises a reservoir barrel 4 and a neck 5 whereon there are cut two tabs 6*a*, 6*b* provided on their external side with a catch 7*a*, 7*b*. Neck 5 is extended within the reservoir barrel 4 of the container by a resilient sleeve 5*a* at the bottom 5*b* of which is an opening.

Applicator 2 is formed by a cap 2*a* having internally thereof an oblong central stem 9 disposed axially within the applicator and fixed thereto by an elastic connection 8. This cap 2*a* is made in two parts, the one part, 2*b*, forming the side wall of the cap and the other part 10, coming to surmount the open top end of cap 2*a* and having internally a socket 10*a* which slidably receives the upper end of the central applicator stem 9. The elastic connection 8 is advantageously integrally moulded with the side wall 2*b* of cap 2*a* and comprises a plurality of upwardly bent cross pieces, for instance, three cross pieces 8*a*, 8*b*, 8*c*, bearing on a flange 8*d* which is force-fitted within a peripheral groove provided on the stem 9. On the side wall 2*b* of cap 2*a*, are two diametrically opposed tongues 11*a*, 11*b* having external bulges. The applicator stem 9 carries, at its lower end, a make-up member 12 serving to take up the liquid make-up composition from barrel 4 of the container 3, to carry it, and then to spread it on the eyelids. The make-up member 12, is obtained by moulding of soft natural or synthetic rubber and comprises a spatula 12*a* with an elongated flat shape and having arranged therein two holes 12*b* shaped to hold the drawn-off liquid by capillarity during the transit of the spatula from container 3 to the eyelids to be made up, the liquid then being applied by a slight pressure exerted on spatula 12*a*. A make-up member 12 of this type is described in greater detail in U.S. patent application Ser. No. 349,404 filed Feb. 16, 1982.

The opening at the bottom of glove finger 5*a* is edged by a peripheral lip 5*b* intended to exert a wiping action, that is to say to dispose of the excess liquid make-up composition taken up by spatula 12 when the applicator is being extracted from the container 3 by the user; the wiper lip 5*b* closely surrounds the surface of spatula 12 when container 3 is closed.

An annular collar 14 integrally moulded together with the spatula 12 abuts the bottom of the glove finger 5*a* when the container 3 is closed, to ensure leak-proof stoppering of the opening defined by the wiper lip.

The operation of stoppering the container 3 by means of the applicator 2 described above, is effected as follows: the cap 2*a* whose lower edge strikes the catches 7*a*, 7*b* provided respectively on tabs 6*a*, 6*b* causing them to retract is lowered towards the container 3 and the lowering is continued until the said catches engage in the lower slots of the cut-outs defining tongue 11*a*, 11*b* of cap 2*a*. The wall 2*b* of this cap 2*a* has sufficient height for its lower edge, in this locking position of cap 2*a* on neck 5 of container 3, to bear with slight clearance on the shoulders 3*a* arranged at the bottom of the neck 5 of container 3. During this assembly operation, the stem 9 of the applicator is always held axially within the neck 5 and each time it is necessary to apply a force, especially when the make-up member 12 is being lowered into the hole of the resilient sleeve 5*a*, the upper end of the stem 9 slides in the socket 10*a* and comes to abut on the bottom of the cover 10, thanks to the elastic connection 8 which, on completion of assembly, causes the various components to take up their appropriate position.

During making-up, when the operator wishes to extract the applicator from the container 3, she exerts inward pressure on tongues 11*a*, 11*b* so as to deflect the tabs 6*a*, 6*b* towards the applicator stem 9, and thus to retract the catches 7*a*, 7*b* carried by these tabs. Thereupon, she causes the lower part of the cap 2*a* to pass over the catches 7*a*, 7*b* in an ascending translational movement and, by pursuing this ascending movement, thus separates the applicator 2 from the container 3. During this operation, the applicator stem 9 is extracted with its spatula 12 from the container 3 whilst remaining coaxial with the neck 5 of container 3. When the applicator 2 has been completely disengaged from the catches of the neck 5, tabs 6 automatically take up their original position because of their elasticity. It will be observed that during this extraction stage of the applicator 2 from the container 3, as well as during repositioning of the applicator within the container, the operator's fingers are not at risk of coming into contact with stem 9 of applicator 2, and this avoids all risk of dirtying the operator's fingers.

It shall be duly understood that the embodiment described above is in no way restrictive and may give rise to any desirable modifications without thereby departing from the scope of the invention as defined by the claims.

I claim:

1. In a make-up comprising:

(a) a container for liquid make-up;

(b) neck means to said container;

(c) a resilient sleeve in said container having an open end adjacent said neck and a bottom remote from said neck;

(d) a detachable applicator consisting of an applicator stem having an upper end and a lower end;

(e) a make-up member carried by said lower end of the applicator stem and bearing in a leak-proof manner on said bottom of the resilient sleeve;

(f) means defining an opening in said bottom, the make-up member being adapted to pass through the said bottom via said opening to penetrate into the container; and (g) a cap surmounting the container and integral with said applicator stem, the improvement wherein:

(h) elastic connector means are provided to connect the applicator stem to the cap so as to obtain a relative translational axial movement between the cap and the applicator stem;

(i) the cap includes cut out means defining at least one tongue having a lower edge; and (j) the neck includes at least one longitudinal flexible tab and relief means carried thereby, said relief means and said at least one tongue being positioned such that on completion of assembly of the unit said at least one tongue is level with said relief means, said relief means being adapted to be engaged in said cut-out means adjacent said lower edge of said at least one tongue, and said at least one tongue being adapted to be deformed by pressure on said at least one flexible tongue to retract said shape means for allowing separation of the applicator from the container by a translational movement.

2. A make-up unit according to claim 1, wherein said cap comprises a side wall, wherein the applicator stem includes peripheral groove means, and wherein said elastic connector means comprises (i) a plurality of upwardly bent cross pieces fixed to said side wall of the cap and (ii) a flange force-fitted in said peripheral groove means.

3. A make-up unit according to claim 1, wherein said elastic connector means are integrally moulded with said cap.

4. A make-up unit according to claim 1, wherein said relief means comprise a catch having a shoulder which in the closed position of the make-up unit faces away from the lower edge of said tongue and a bevelled zone which in said position slopes towards the free lower edge of said tongue.

5. A make-up unit according to claim 1, wherein the cap is constituted by a cylindrical element forming a lateral wall thereof and a cover closing the cylindrical element at its top part.

6. A make-up unit according to claim 5, wherein the cover of the cap is provided with a socket for the upper end of said applicator stem.

7. A make-up unit according to claim 1, wherein the make-up member comprises an oblong spatula including means defining at least one through hole which constitutes a reservoir wherein liquid make-up composition will be held by capillarity.

8. A make-up unit according to claim 7, wherein the opening in the bottom of the resilient sleeve constitutes a wiper lip for the spatula of the make up member.

9. A make-up unit according to claim 1, wherein there are two diametrically opposite said tongues, and including means on each said tongue defining an external bulge thereof, said tongues being arranged on the side wall of the cap of the make-up unit so as to cooperate respectively with two said relief formations, each said relief formation comprising a catch carried by one of two diametrically opposite said longitudinal flexible tabs on the neck of the container so as to lock the applicator releasably on the container.

10. A make-up unit according to claim 2, wherein said elastic connector means are integrally moulded with said cap.

11. A make-up unit according to claim 2, wherein said relief means comprise a catch having a shoulder which in the closed position of the make-up unit faces away from the lower edge of said tongue and a bevelled zone which in said position slopes towards the free lower edge of said tongue.

12. A make-up unit according to claim 11, wherein the make-up member comprises an oblong spatula including means defining at least one through hole which constitutes a reservoir wherein liquid make-up composition will be held by capillarity.

13. A make-up unit according to claim 11, wherein there are two diametrically opposite said tongues, and including means on each said tongue defining an external bulge thereof, said tongues being arranged on the side wall of the cap and the make-up unit so as to cooperate respectively with two said relief formations, each said relief formation comprising a catch carried by one of two diametrically opposite said longitudinal flexible tabs on the neck of the container so as to lock the applicator releasably on the container.

14. A make-up unit according to claim 2, wherein there are two diametrically opposite said tongues, and including means on each said tongue defining an external bulge thereof, said tongues being arranged on the side wall of the cap of the make-up unit so as to cooperate respectively with two said relief formations, each said relief formation comprising a catch carried by one of two diametrically opposite said longitudinal flexible tabs on the neck of the container so as to lock the applicator releasably on the container.

* * * * *